US006223131B1

(12) United States Patent
Kanaya et al.

(10) Patent No.: US 6,223,131 B1
(45) Date of Patent: Apr. 24, 2001

(54) INK CARTRIDGE FOR AN INK-JET RECORDING APPARATUS, AND A SYSTEM FOR DETECTING AND DISPLAYING AN INK CONSUMPTION STATE OF AN INK CARTRIDGE

(75) Inventors: Munehide Kanaya; Takao Kobayashi; Hisashi Miyazawa; Eiko Yanagida; Kazuo Koshino, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 08/681,722

(22) Filed: Jul. 29, 1996

(30) Foreign Application Priority Data

Jul. 29, 1995 (JP) ..... 7-212761
Jul. 26, 1996 (JP) ..... 8-214058

(51) Int. Cl.[7] ..... B41J 2/175

(52) U.S. Cl. ..... 702/55; 347/7; 347/86; 399/24; 399/27; 399/28

(58) Field of Search ..... 364/550; 347/7, 347/84, 85, 86, 87; 101/364, 365; 399/24, 27, 28; 702/55

(56) References Cited

U.S. PATENT DOCUMENTS

| | | | | |
|---|---|---|---|---|
| 4,935,751 | | 6/1990 | Hamiin | 347/86 |
| 5,159,546 | * | 10/1992 | Inoue et al. | 364/146 |
| 5,182,796 | * | 1/1993 | Shibayama et al. | 345/353 |
| 5,357,347 | * | 10/1994 | Hirose et al. | 347/7 |
| 5,365,312 | * | 11/1994 | Hillmann et al. | 347/86 |
| 5,459,556 | * | 10/1995 | Acquaviva et al. | 399/58 |
| 5,635,972 | * | 6/1997 | Maruyama et al. | 347/158 |
| 5,652,610 | * | 7/1997 | Kawai et al. | 347/87 |
| 5,657,057 | * | 8/1997 | Nakajima et al. | 347/7 |
| 5,663,750 | * | 9/1997 | Sakuma | 347/7 |
| 5,682,140 | * | 10/1997 | Christensen et al. | 340/540 |

FOREIGN PATENT DOCUMENTS

| | | |
|---|---|---|
| 0 519 700 | 12/1992 | (EP) . |
| 0 551 014 | 7/1993 | (EP) . |
| 0 624 476 | 11/1994 | (EP) . |
| 0683 052 A2 | 11/1995 | (EP) . |
| 2173901 | 10/1986 | (GB) . |
| 2296093 | 6/1996 | (GB) . |
| 62-25216 | 2/1987 | (JP) . |
| 1-195049 | 8/1989 | (JP) . |
| 3-032851 | 2/1991 | (JP) . |
| 6-015843 | 1/1994 | (JP) . |
| 6-155761 | 6/1994 | (JP) . |
| 7-25030 | 1/1995 | (JP) . |
| 7-125236 | 5/1995 | (JP) . |

OTHER PUBLICATIONS

French Search Report No. 9902547000.
"Epson zielt mit Tintentechnologie auf den Lasermarkt" In special publication of PC–Magazine, 1993, No. 9.

* cited by examiner

*Primary Examiner*—Eric W. Stamber
(74) *Attorney, Agent, or Firm*—Stroock & Stroock & Lavan LLP

(57) ABSTRACT

An ink cartridge for an ink-jet recording apparatus, comprises: a tank housing containing ink, the ink being visible from an outside; and indications, marked along a depth direction of the tank housing, for displaying the number and size of record sheets which can be subjected to printing, corresponding to a quantity of remaining ink. Alternately, at least an ink consumption state and enablement or disablement of printing are displayed on a cathode ray tube (CRT) screen.

9 Claims, 10 Drawing Sheets

INK CARTRIDGE FOR AN INK-JET RECORDING APPARATUS, AND A SYSTEM FOR DETECTING AND DISPLAYING AN INK CONSUMPTION STATE OF AN INK CARTRIDGE

BACKGROUND OF THE INVENTION

The invention relates to an ink-jet recording apparatus such as an ink-jet printer, an ink jet facsimile printer or an ink-jet plotter, and particularly to an ink cartridge for an ink-jet recording apparatus which can accurately detect and display the consumption state of ink in the recording apparatus, thereby preventing an accidental event such as a sudden ink end from occurring, and also to an apparatus for detecting and displaying an ink consumption state of an ink cartridge.

One method of detecting the quantity of remaining ink of an ink cartridge in an ink-jet recording apparatus is disclosed in FIG. 3 of Japanese patent Application Laid-open No. Hei. 7-125236. In the method, a scale for visual checking is formed on an ink chamber of an ink tank so that the number of sheets which can be further subjected to printing is displayed.

The above method technique has a convenience that the user can know the quantity of remaining ink as required by means of a relatively simple method. However, the user cannot know which size corresponds to the displayed number of sheets which can be further subjected to printing. Therefore, the conventional method technique has room for improvement.

Moreover, the above method has a drawback that an ink chamber in which a porous member is not housed is required and the ink chamber is required to be composed of a transparent material so that the quantity of remaining ink can be seen from the outside, thereby restricting the shape of an ink cartridge.

The conventional method technique has a further drawback that, in order to visually check the ink cartridge, it is necessary that the cover of a printer is opened or the ink cartridge is detached from the printer.

The detachment of an ink cartridge may cause the following problems. When an ink cartridge in use is detached, air is allowed to enter the ink supply path, thereby producing a problem that an ejection failure may occur. During the process of detaching an ink cartridge in use, there arise problems in that the user's hands or the like may be soiled with ink, and that the user may be anxious about damage to the printer or the ink cartridge.

SUMMARY OF THE INVENTION

The invention has been conducted in order to improve the conventional method or solve the problems of the conventional method. It is an object of the invention to provide an ink cartridge which allows the user to readily know the consumption state of ink in the ink cartridge as required in a more easy-to-understand manner.

It is another object of the invention to provide an ink cartridge in which restriction in visual checking of ink level does not result from the material and shape of the ink cartridge.

It is a further object of the invention to provide an apparatus for detecting and displaying an ink consumption state of an ink cartridge which allows the user to check the consumption state of ink in the ink cartridge and whether printing is enabled or not, without opening the cover of a printer or detaching the ink cartridge from the printer.

It is a still further object of the invention to provide an apparatus for detecting and displaying an ink consumption state of an ink cartridge which allows the user to determine the continuation of the printing process without feeling anxiety about the quantity of remaining ink.

It is a still further object of the invention to provide an apparatus for detecting and displaying an ink consumption state of an ink cartridge which allows the user to visually check the consumption state of ink and the replacement of the ink cartridge, and which can more positively attract the attention of the user about the replacement of the ink cartridge.

According to a first aspect of the invention, there is provided an ink cartridge for an ink-jet recording apparatus, comprising: a tank housing which contains ink, the ink being visible from the outside; and displaying means, marked along a depth direction of the tank housing, for displaying the number and size of record sheets which can be subjected to printing, corresponding to a quantity of remaining ink.

According to a second aspect of the invention, there is provided an apparatus for detecting and displaying an ink consumption state of an ink cartridge for an ink-jet recording apparatus, comprising: housing means for supporting the ink cartridge in a vertically movable manner in accordance with a weight of remaining ink; and displaying means, marked as a scale along a depth direction of at least one of the housing means and the ink cartridge, for enabling a quantity of remaining ink of the ink cartridge to be detected in accordance with a vertical moving state of the ink cartridge in the housing means.

According to a third aspect of the invention, there is provided an apparatus for detecting and displaying an ink consumption state of an ink cartridge according to the second aspect, wherein urging means for supporting the ink cartridge and urging the ink cartridge along a direction in which the ink cartridge is projected from the housing means is attached to an inner bottom face of the housing means.

According to a fourth aspect of the invention, there is provided an apparatus for detecting and displaying an ink consumption state of an ink cartridge according to the second aspect, wherein the housing means is made of a material through which a body in the housing means can be seen.

According to a fifth aspect of the invention, there is provided an apparatus for detecting and displaying an ink consumption state of an ink cartridge according to the second aspect, wherein the ink cartridge is projected from the housing means, thereby enabling the displaying means to conduct detection.

According to a sixth aspect of the invention, there is provided an apparatus for detecting and displaying an ink consumption state of an ink cartridge, wherein an ink-jet recording apparatus is connected to a host computer, and at least an ink consumption state and enablement or disablement of printing are displayed on a CRT screen as a result of operation of the host computer.

According to a seventh aspect of the invention, there is provided an apparatus for detecting and displaying an ink consumption state of an ink cartridge according to the sixth aspect, wherein the number and size of record sheets which can be subjected to printing are further displayed on the CRT screen, corresponding to a quantity of remaining ink.

According to an eighth aspect of the invention, there is provided an apparatus for detecting and displaying an ink consumption state of an ink cartridge according to the sixth aspect, wherein instructions for replacement of the ink cartridge is further displayed on the CRT screen.

According to a ninth aspect of the invention, there is provided an apparatus for detecting and displaying an ink consumption state of an ink cartridge according to the sixth aspect, wherein a color of ink which is currently used is further displayed on the CRT screen.

According to a tenth aspect of the invention, there is provided an apparatus for detecting and displaying an ink consumption state of an ink cartridge according to the sixth aspect, wherein a state for each of remaining inks of plural colors is displayed on the CRT screen.

DETAILED DESCRIPTION OF THE PREFERRED EMBODIMENTS

Hereinafter, illustrated embodiments will be described.

(First embodiment)

In a first embodiment, an ink cartridge 1 can be directly visually checked so as to detect the quantity of remaining ink.

Figure 1:
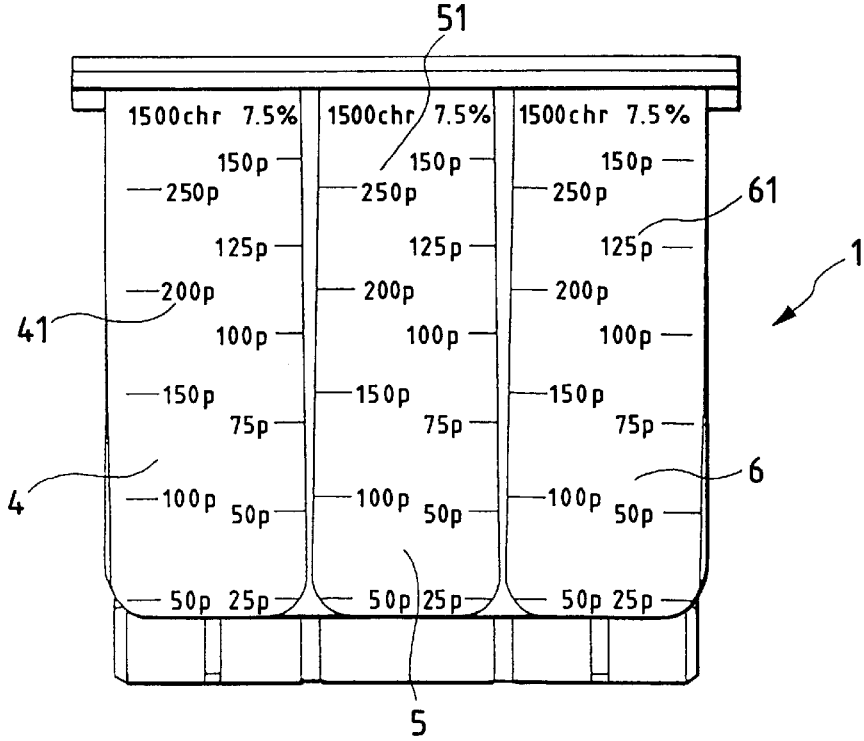
FIG. 1 is a front view showing a first embodiment of the ink cartridge of the invention.
Figure 2:
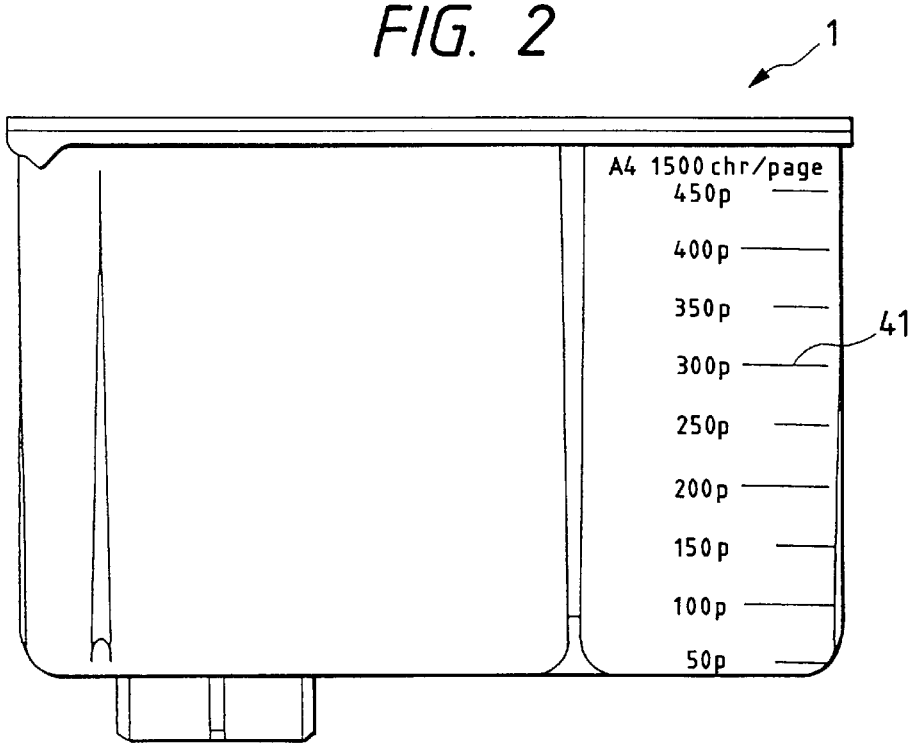
FIG. 2 is a side view of the ink cartridge of FIG. 1.
Figure 3:
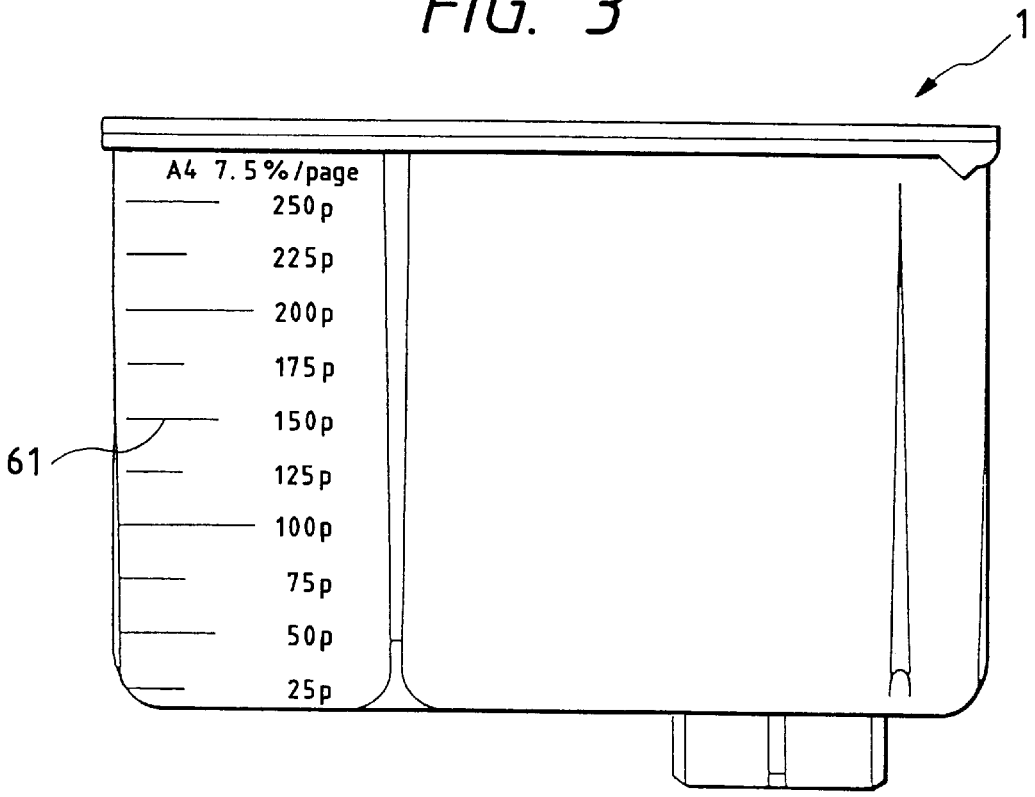
FIG. 3 is a back view of the ink cartridge of FIG. 1.

As shown in FIGS. 1 to 4, in the ink cartridge 1, color inks $C_1$ to $C_3$ of yellow, magenta, and cyan are filled into chambers 4, 5, and 6 which are separated from each other by partition walls 2 and 3, respectively. The ink cartridge 1 is composed of a transparent material so that the quantity of remaining ink can be seen from the outside. In other words, the consumption states of the contained inks $C_1$ to $C_3$ can be visually checked from the outside. Indication scales 41, 51, and 61 are formed on the chambers 4, 5, and 6 along the depth direction, respectively. In the cases of FIGS. 1 to 3, the quantity of ink to be consumed is estimated from the average ink consumption quantity of characters, symbols, illustrations, and the like to be printed, and the indication scales 41, 51, and 61 are sheet-number indication scales which indicate the quantities of the remaining inks of the chambers 4, 5, and 6 in the form of the number of sheets which can be further subjected to printing (hereinafter, such a number is often referred to as "the number of printable sheets") and the corresponding paper size.

According to this configuration, in order to know the quantity of remaining ink and "How many sheets of a certain size can be further subjected to printing," the operator is requested only to see the indication scales 41, 51, and 61. Therefore, an ink depletion is prevented from accidentally occurring.

Figure 4:
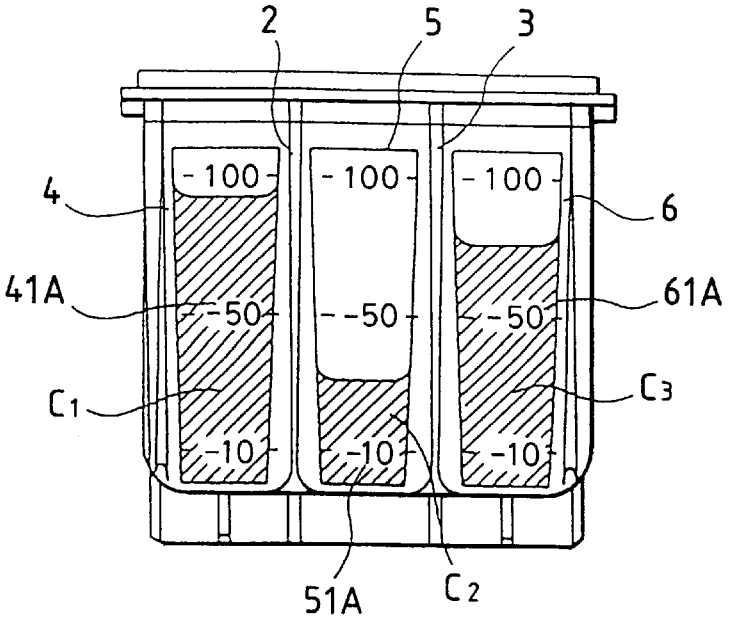
FIG. 4 is a front view of a modification of the ink cartridge of FIG. 1.

It is a matter of course that, as shown in FIG. 4, indication scales 41A, 51A, and 61A indicating the quantities of remaining inks in the unit of percentage may be used.

(Second embodiment)

A second embodiment has in common with the first embodiment the configuration in which the quantity of remaining ink can be known by visually checking an ink cartridge 100. The second embodiment has the following features.

Figure 5:
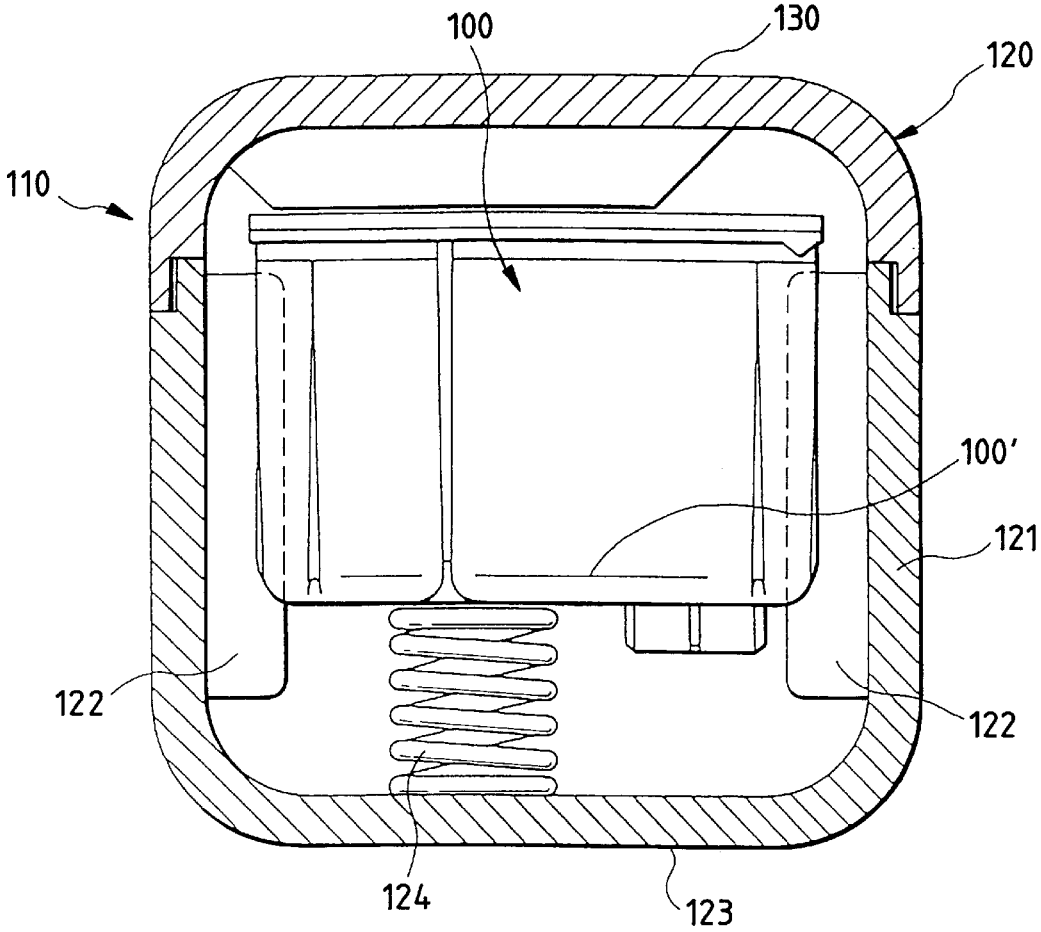
FIG. 5 is a longitudinal section view of a second embodiment of the apparatus for detecting and displaying an ink consumption state of the invention.

As shown in FIG. 5, a consumption state detecting and displaying apparatus 110 comprises the ink cartridge 100, and a storage container 120. The storage container 120 stores the ink cartridge 100 which is detached from the body of a printer (not shown). The storage container 120 is formed by a transparent member having a lid 130 which is openable. Guide frames 122 which guide the ink cartridge 100 in a vertically movable manner project from the inner face of the side wall 121 of the storage container 120. A support spring (elastic member) 124 which supports the bottom of the ink cartridge 100 is compressedly disposed on the bottom wall 123 of the storage container 120.

Figure 6:
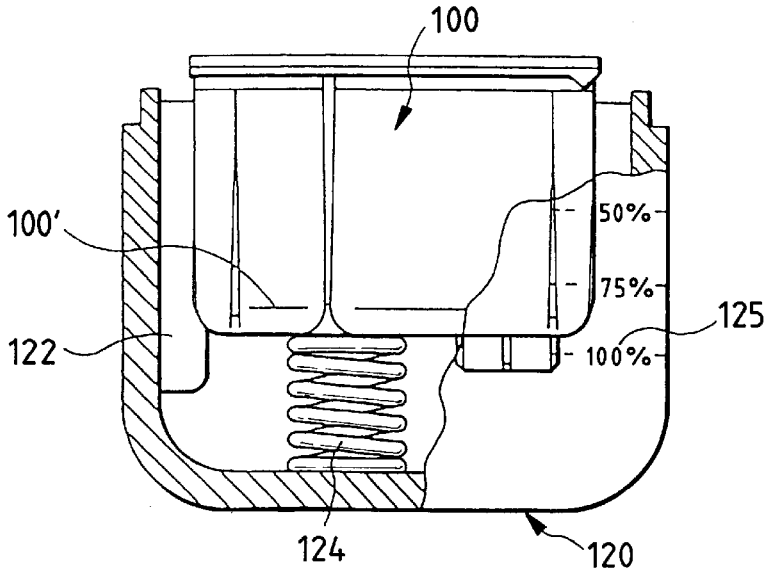
FIG. 6 is a partial longitudinal section view in which a lid in FIG. 5 is removed away.

An indication scale 125 through which the vertical position of the ink cartridge 100 can be seen and detected is marked on the side wall 121 of the storage container 120. For example, the indication scale 125 is configured so as to indicate the quantity of remaining ink in the unit of percentage as shown in FIG. 6. Therefore, the operator can detect the position of the ink cartridge 100 from the outside of the storage container 120, according to the indication scale 125, so that the quantity of remaining ink in the ink cartridge 100 is easily detected. In addition, a detection line 100' is formed on the ink cartridge 100.

Consequently, the position of the ink cartridge 100 which is raised by the support spring 124 as a result of the weight reduction due to consumption of ink can be seen by the combination of the detection line 100' and the indication scale 125 so that the quantity of consumed ink is visually recognized in the unit of percentage.

It is a matter of course that, in the same manner as the first embodiment, the indication scale 125 may be configured so as to indicate the number and the size of sheets.

(Third embodiment)

Figure 7:
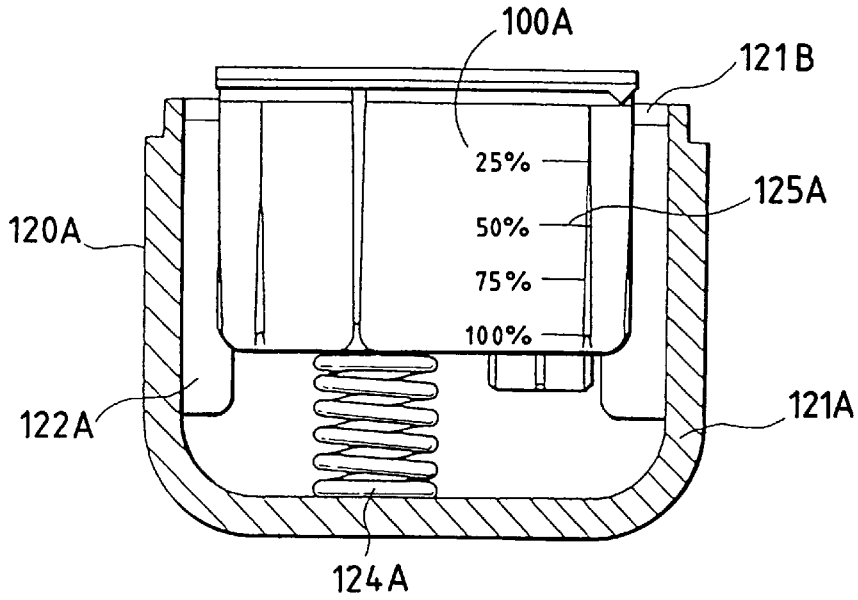
FIG. 7 is a longitudinal section view of a third embodiment of the apparatus for detecting and displaying an ink consumption state of the invention.
Figure 8:
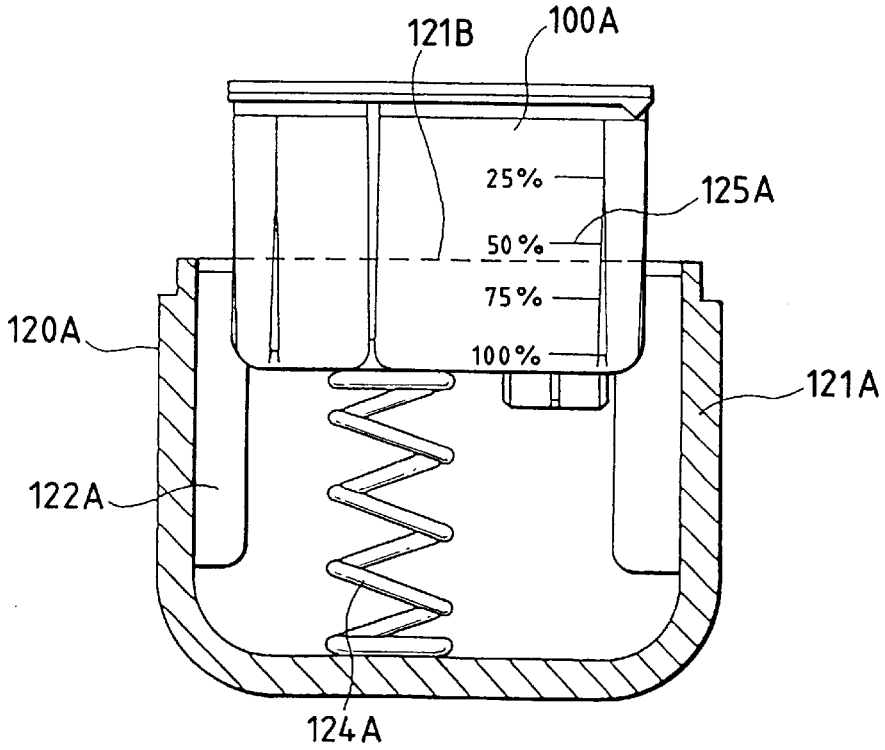
FIG. 8 is a longitudinal section view showing another state of the apparatus of FIG. 7.

As shown in FIGS. 7 and 8, in a consumption state detecting and displaying apparatus 110A of a third embodiment, an indication scale 125A which indicates the ink consumption state in the unit of percentage is formed on an ink cartridge 100A. The variation of the vertical position of the ink cartridge 100A can be seen by using the top edge 121B of the side wall 121A of a storage container 120A.

Therefore, it is apparent that the storage container 120A is not necessarily required to be transparent.

In FIGS. 7 and 8, 122A designates guide frames, and 124A a support spring.

When the embodiment is to be used, a lid (not shown) is removed away, and the ink cartridge 100A is supported by the support spring 124A in such a manner that its vertical position is variable. The vertical position of the ink cartridge 100A is seen by using the top edge 121B of the storage container 120A and the ink consumption state can be visually recognized by the indication scale 125A.

(Fourth embodiment)

In a fourth embodiment, the quantity of remaining ink in an ink tank, and the like are displayed on a screen of a CRT, thereby informing the operator of "How many sheets of a certain size can be further subjected to printing."

Figure 9:
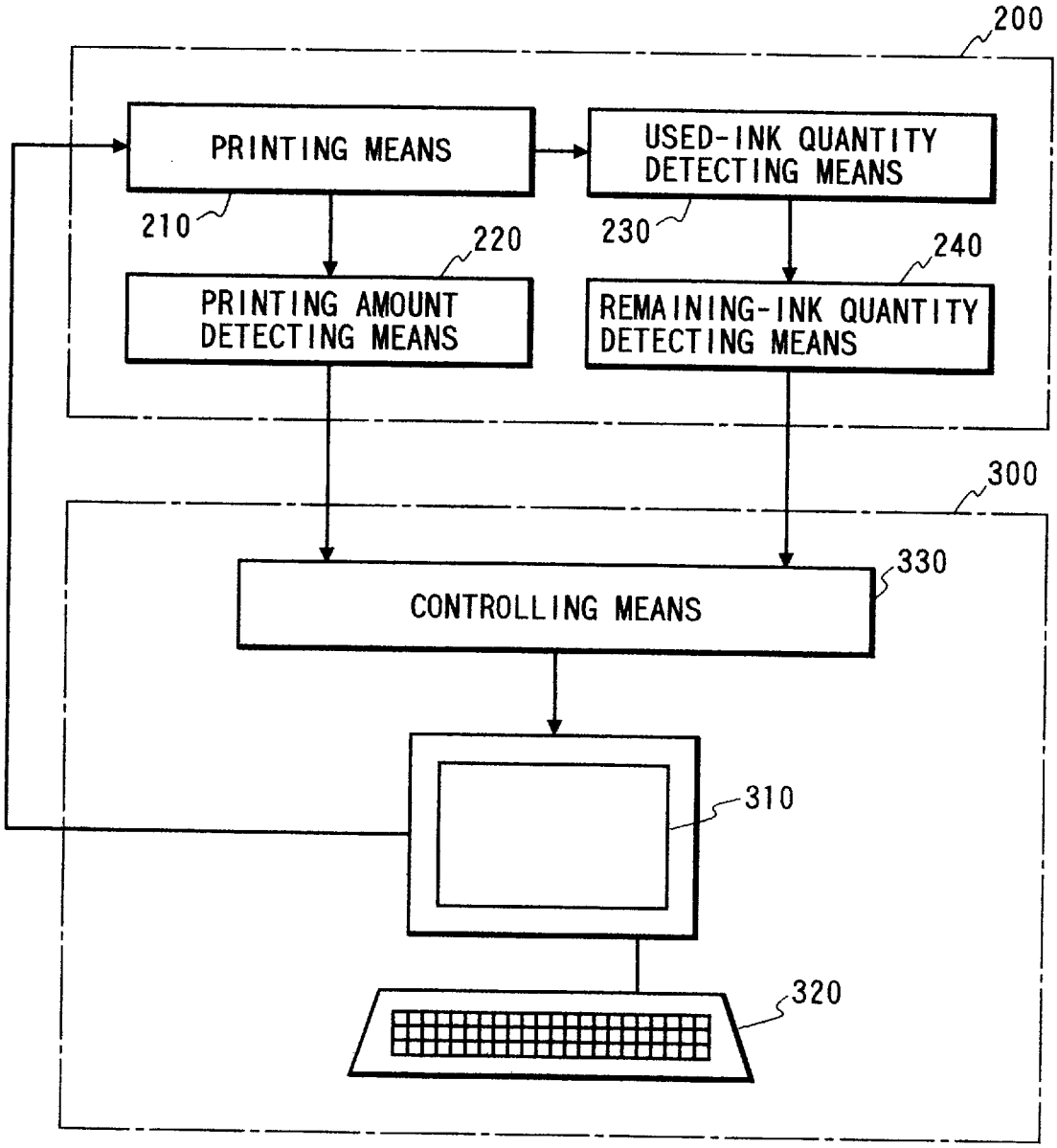
FIG. 9 is a functional block diagram of a fourth embodiment of the apparatus for detecting and displaying an ink consumption state of the invention.

As shown in FIG. 9, a printer 200 is connected to a personal computer 300 so that the ink consumption state is displayed on a screen 310 of the CRT. In other words, the personal computer 300 to which a keyboard 320 is connected to the printer 200 and a print command is given by operating the keyboard. The amount of the print processing conducted by printing means 210 of the printer 200 is detected by printing amount detecting means 220. The data of the detected amount is transmitted to controlling means 330 of the personal computer 300.

The quantity of ink used in the print processing is detected by used-ink quantity detecting means 230. On the basis of the quantity from which the generation quantity of the detected used-ink quantity is subtracted, the quantity of remaining ink is detected by remaining-ink quantity detecting means 240. Also the data of the detected quantity is transmitted to the controlling means 330.

The controlling means 330 controls the CRT so that the printing enabled state is displayed in first and second display areas 311 and 312 on the CRT screen 310 as described later.

In the first display area 311, the number of printed sheets which is calculated on the basis of the detection data of the printing amount detecting means 220 is displayed. The data indicative of the quantity of remaining ink which is detected by the remaining-ink quantity detecting means 240 or by the subtraction of the generation quantity of the used-ink quantity detected by the used-ink quantity detecting means 230 is converted to the number of printable sheets. The number and the paper size are displayed in the first display area 311.

The second display area 312 is provided with an indicating lamp for each of the color inks, i.e., indicating lamps $L_1$, $L_2$, and $L_3$ which blink. In accordance with the data of the remaining-ink quantity detecting means 240, the indicating lamps $L_1$, $L_2$, and $L_3$ are blinkingly displayed, whereby the states of the remaining inks are displayed in a manner that visually attracts the attention of the operator.

Accordingly, the operator can operate the keyboard 320 so as to give the print command to the printing means 210. In response to the input of the print command, "Printing OK" or "Printing NO" is displayed, and, in response to the input of "Quantity of Remaining Ink," "Number and Size of Printable Sheets" are displayed in the first display area 311. When the operator visually checks the indicating lamp $L_1$, $L_2$, or $L_3$ of the second display area 312, it is possible to approximately know also the quantity of the remaining ink of each color.

(Fifth embodiment)

Figure 10:
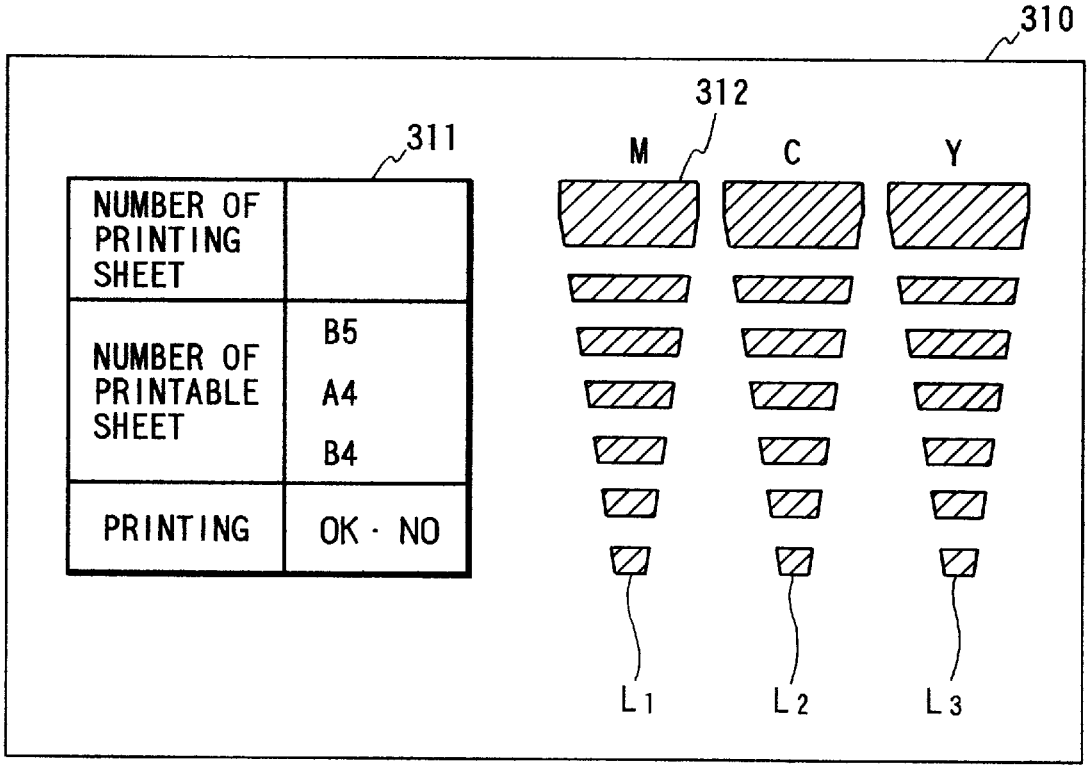
FIG. 10 is a diagram showing a display unit in FIG. 9.

In the consumption state detecting and displaying apparatus of a fifth embodiment, information which is different in form from that shown in FIG. 10 is displayed on the CRT screen 310. Namely, an indication 401 of the type of the printer in which the ink cartridges are currently used, an indication 402 of the print output port, an indication 403 of whether printing is enabled or not, an illustration 404 of the states of remaining inks of the color ink tanks, an illustration 405 of the state of remaining ink of the black ink tank, and the like are displayed.

Figure 11:
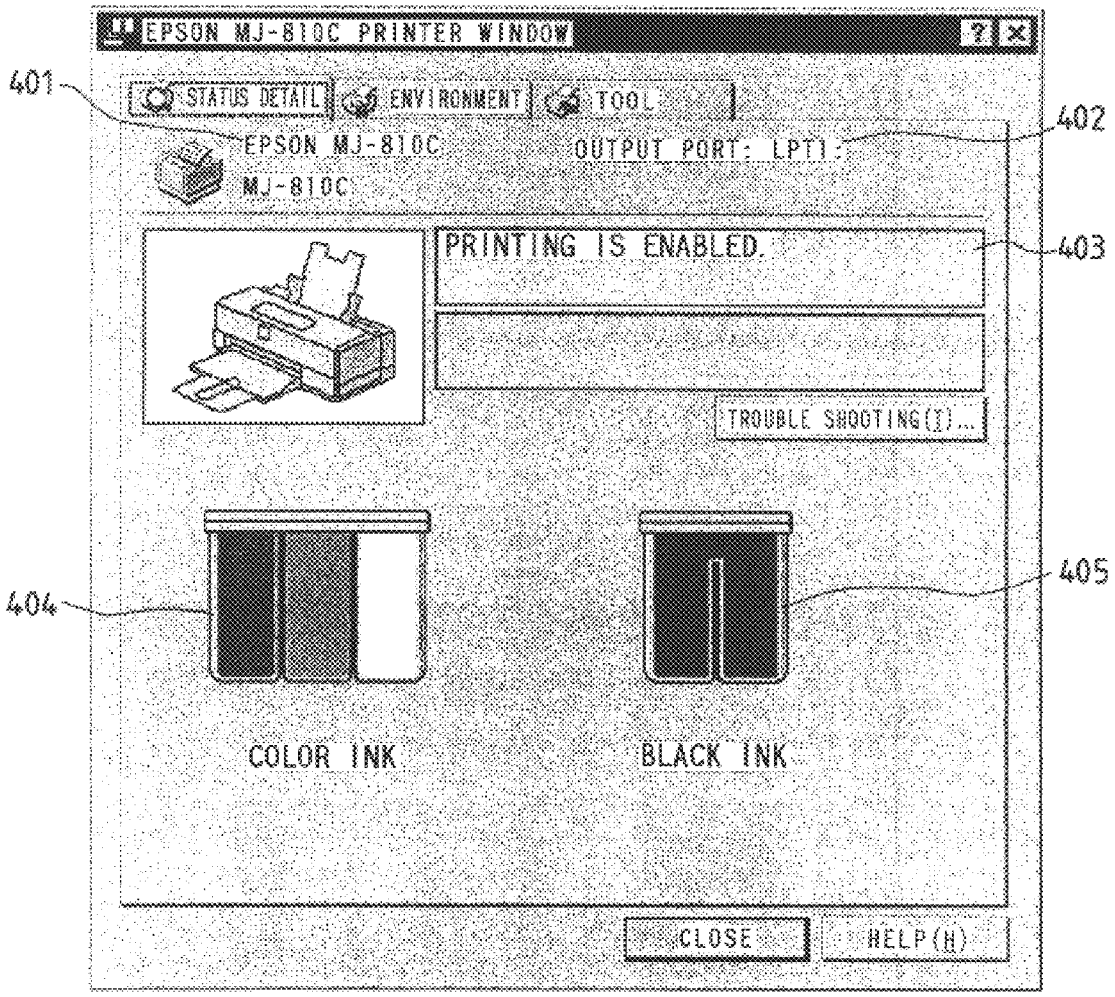
FIG. 11 is a diagram of a display unit of a fifth embodiment of the apparatus for detecting and displaying an ink consumption state of the invention.

In FIG. 11, the indications 404 and 405 show the filled states of the color ink tanks and the black ink tank, and the indication 403 shows "Printing is Enabled."

Figure 12:
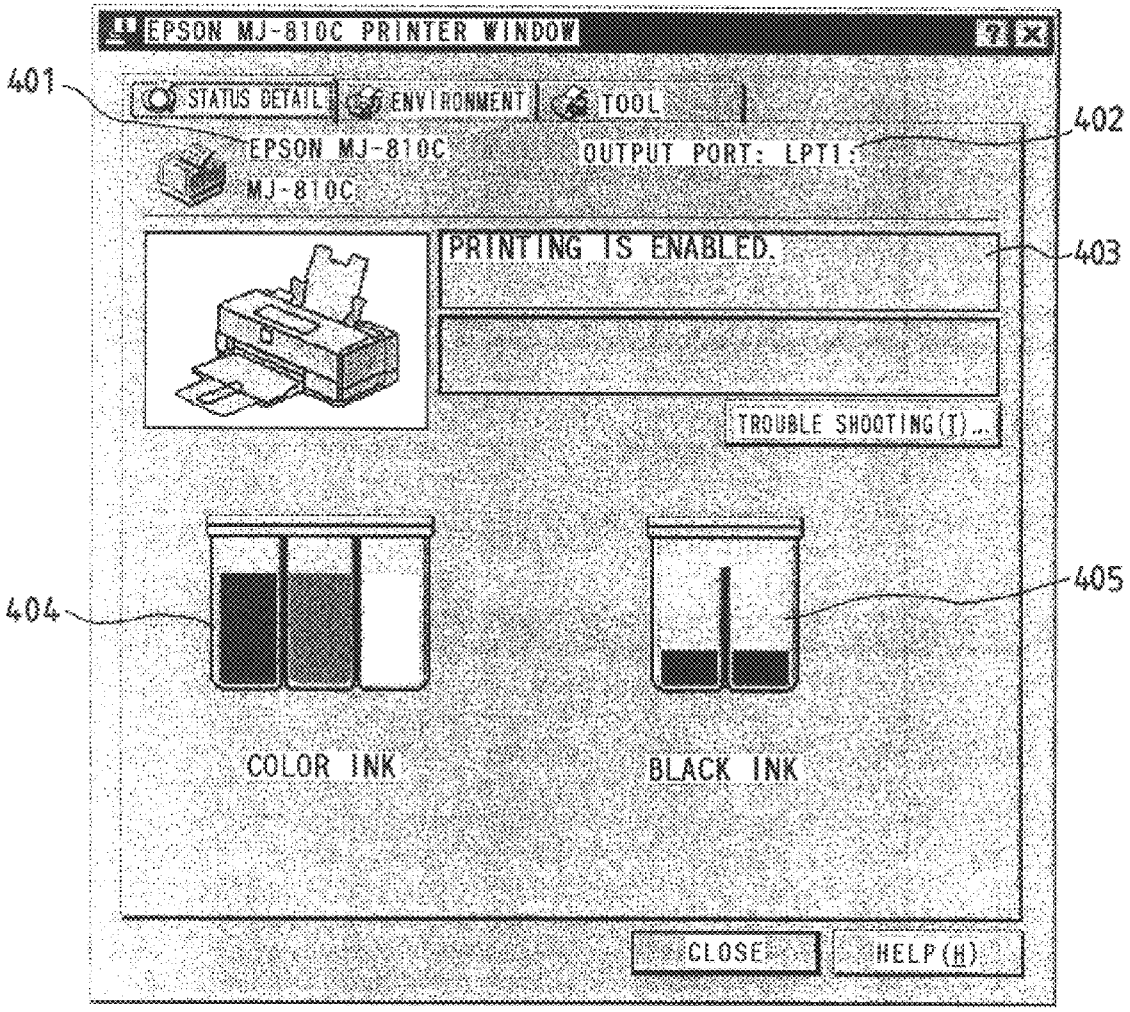
FIG. 12 is a diagram of the display unit of FIG. 11 showing another state.

In FIG. 12, the indications 404 and 405 show the reduced states of the ink tanks. Since the indications 404 and 405 are conducted by means of illustrations of the tanks in this way, the states of remaining inks can be visually recognized. In the same manner as FIG. 11, the indication 403 shows "Printing is Enabled."

Figure 13:
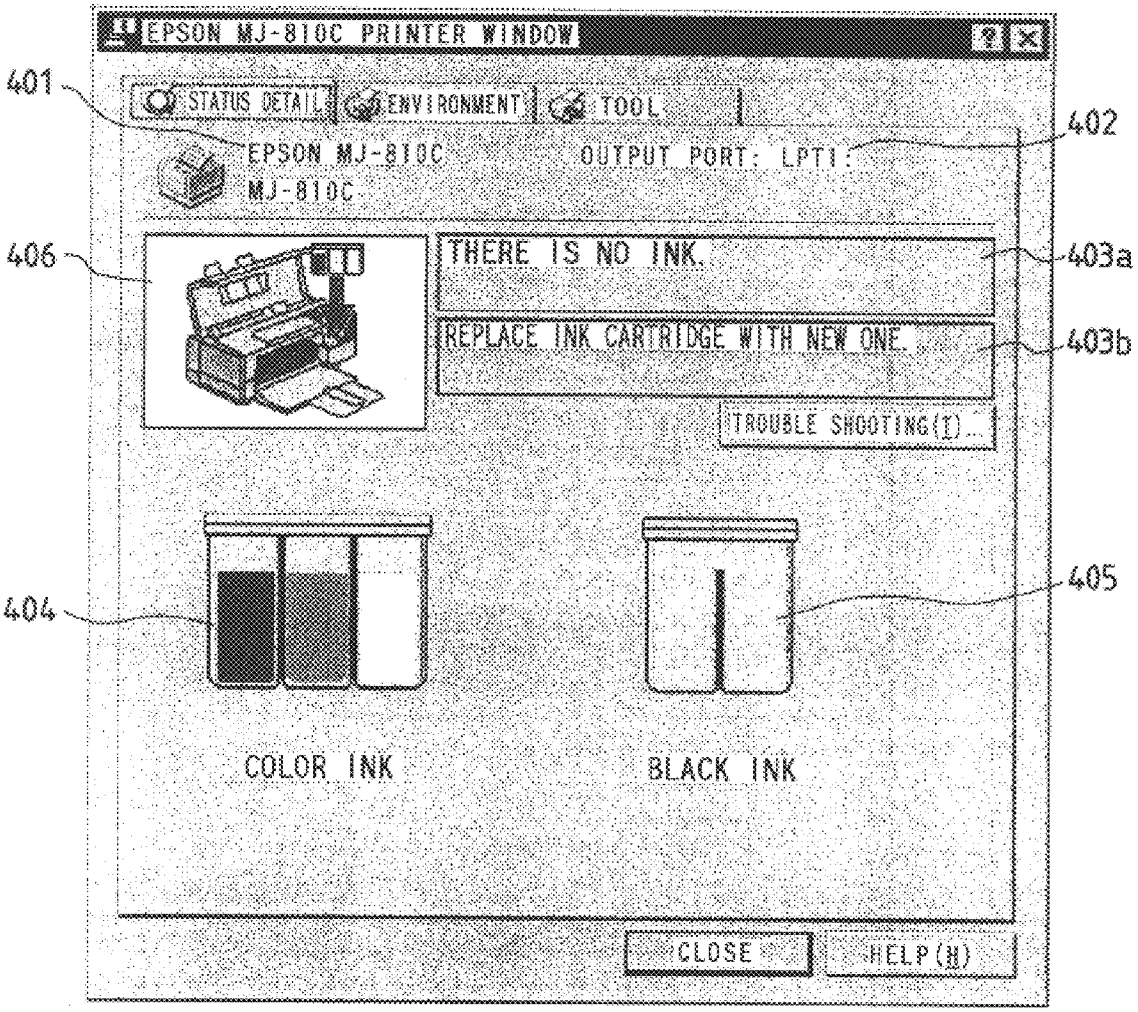
FIG. 13 is a diagram of the display unit of FIG. 11 showing a further state.

In FIG. 13, the indication 405 shows that the quantity of remaining ink of the black ink tank reaches zero. Therefore, an indication 403*a* shows "There is No Ink," and an indication 403*b* "Replace Ink Cartridge with New One." Furthermore, an indication 406 shows an illustration which displays the opened lid of the printer and indicates the position where the ink cartridges are mounted. Consequently, the attention of the user is visually directed to the replacement of the ink cartridge, not only by the character information but also by the illustrations.

(Sixth embodiment)

In the consumption state detecting and displaying apparatus of a sixth embodiment, the displacement on the CRT screen 310 is conducted in a manner different from that shown in FIGS. 10 to 13. Specifically, an ink-remaining quantity indication 501 for the black ink tank, and ink-remaining quantity indication 502*a* to 502*c* for the cyan, magenta, and yellow ink tanks are displayed in the form of percentages and bars. Furthermore, an indication 503 shows information of the cartridges, for example, "This printer is Black Printer now."

Figure 14:
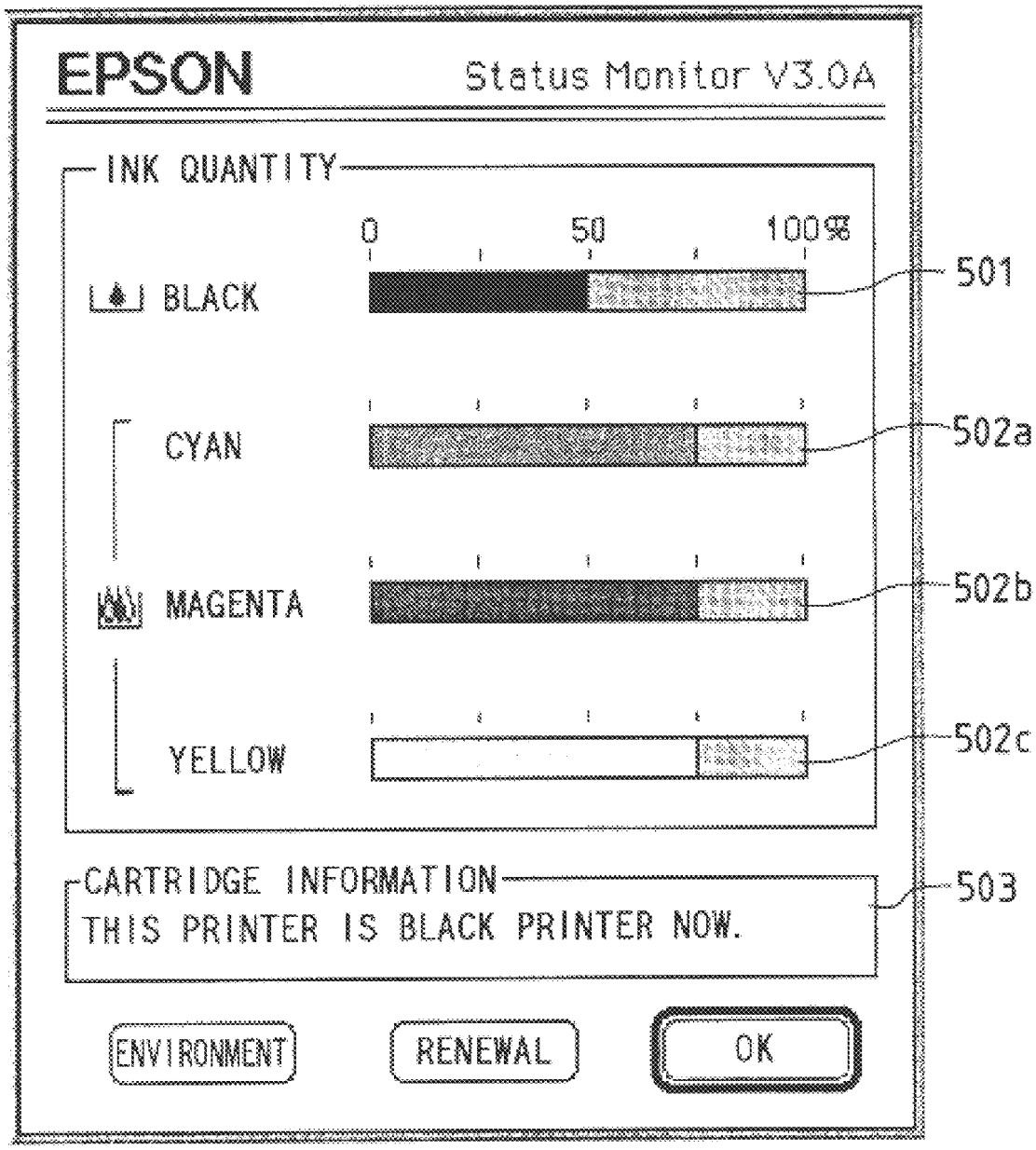
FIG. 14 is a diagram of a display unit of a sixth embodiment of the apparatus for detecting and displaying an ink consumption state of the invention.

In the fifth and sixth embodiments, since the tanks of yellow, magenta, and cyan inks are integrated into one piece, the quantities of remaining color inks are uniformly displayed so as to coincide with the quantity of the ink which is reduced at the highest degree. Alternatively, the quantities of remaining color inks may be independently displayed. The states of remaining inks may be displayed so as to correspond to the reduction of the inks in real time. As shown in FIG. 14, the manner of displaying the quantity of remaining ink may be changed at the timing when the ink quantity is reduced to one of reference values such as 100%, 75%, 50%, 25%, and 0%.

The invention described above can attain the following effects.

(1) According to the ink cartridge or the apparatus for detecting and displaying an ink consumption state of the invention, the user can readily know the quantity of remaining ink in an ink cartridge as required in a more easy-to-understand manner.

(2) An ink cartridge in which restriction in visual checking of ink level does not result from the material and shape of the ink cartridge can be provided.

(3) The display on a CRT screen allows the user to check the consumption state of ink and whether printing is enabled or not, without opening the cover of a printer or detaching an ink cartridge from the printer. Therefore, problems such as the detachment of an ink cartridge in use may cause the recording head to erroneously eject ink are prevented from being produced. Furthermore, the user is prevented from being soiled with ink, and will not be anxious about damage or the like.

(4) According to the ink cartridge or the apparatus for detecting and displaying an ink consumption state constructed in accordance to the invention the invention allows, the user can determine the continuation of the printing process without feeling anxiety about the quantity of remaining ink.

(5) The display on a CRT screen allows the user to visually check the consumption state of ink and the replacement of an ink cartridge, and to more positively attract the attention about the replacement of the ink cartridge.

What is claimed is:

1. A system for detecting and displaying an ink consumption state of an ink cartridge comprising:

an ink-jet recording apparatus having an ink cartridge;

a host computer connected to said ink-jet recording apparatus for receiving therefrom ink consumption information of said ink cartridge;

means for detecting an ink consumption state of said ink cartridge corresponding to a quantity of ink remaining therein; and a display connected to said host computer displaying the ink consumption state of said ink cartridge detected by said detecting means, said display simultaneously displaying a plurality of sheet sizes and a number of printable sheets for each of said plurality of sheet sizes corresponding to the quantity of ink remaining in said ink cartridge, said display also displaying, in response to a print command input to said host computer and related to said ink-jet recording apparatus, whether said ink-jet recording apparatus is available for printing based on the detected ink consumption state of said ink cartridge and based on the print command.

2. The system according to claim 1, wherein said display also displays instructions for replacement of said ink cartridge when the detected ink consumption state is lower than a predetermined minimum level.

3. The system according to claim 1, wherein said display also displays a color of ink in use by said ink-jet recording apparatus in response to the print command.

4. The system according to claim 1, wherein said display also displays an ink consumption state for each of a plurality of ink colors.

5. The system according to claim 1, wherein said display displays an indicator showing the quantity of remaining ink in said ink cartridge.

6. A method for detecting and displaying an ink consumption state of an ink cartridge in an ink-jet recording apparatus connected to a host computer having a display, said method comprising the steps of:

detecting an ink consumption state of the ink cartridge corresponding to a quantity of ink remaining therein;

displaying on the display the detected ink consumption state of the ink cartridge;

simultaneously displaying on the display a plurality of sheet sizes and a number of printable sheets for each of the plurality of sheet sizes, the number of printable sheets for each of the plurality of sheet sizes corresponding to the quantity of ink remaining in the ink cartridge; and displaying on the display, in response to a print command input to the host computer and related to the ink-jet recording apparatus, whether the ink-jet recording apparatus is available for printing based on the detected ink consumption state of the ink cartridge and based on the print command.

7. The method according to claim 6, further comprising the step of:

displaying on the display instructions for replacement of the ink cartridge when the detected ink consumption state is lower than a predetermined minimum level.

8. The method according to claim 6, further comprising the step of:

displaying on the display a color of ink in use by the ink-jet recording apparatus in response to the print command.

9. The system according to claim 6, further comprising the step of:

displaying on the display an ink consumption state for each of a plurality of ink colors.

* * * * *